United States Patent [19]

Hoppe et al.

[11] Patent Number: 4,859,067

[45] Date of Patent: Aug. 22, 1989

[54] BULK MATERIAL MIXER

[75] Inventors: Hans Hoppe, Vogt, Fed. Rep. of Germany; Theodor Breucker, Montreal, Canada; Reinhard Ernst; Robert Storf, both of Weingarten, Fed. Rep. of Germany

[73] Assignee: Waeschle Maschinenfabrik GmbH, Ravensburg, Fed. Rep. of Germany

[21] Appl. No.: 25,125

[22] Filed: Mar. 12, 1987

[30] Foreign Application Priority Data

Mar. 14, 1986 [DE] Fed. Rep. of Germany ..... 3608650

[51] Int. Cl.[4] ..... B01F 13/00

[52] U.S. Cl. ..... 366/341; 366/336; 366/337; 222/564

[58] Field of Search ..... 366/341, 101, 106, 107, 366/184, 189, 336, 337, 340; 222/564, 547

[56] References Cited

U.S. PATENT DOCUMENTS

| | | | |
|---|---|---|---|
| 1,422,559 | 7/1922 | Germani | 222/564 |
| 1,992,581 | 2/1935 | Reeder | 366/341 |
| 2,842,465 | 7/1958 | Harrison | 366/101 |
| 3,258,252 | 6/1966 | Lanier | 366/107 |
| 3,490,655 | 1/1970 | Ledgett | 222/564 |
| 3,854,657 | 12/1974 | Pause | 494/43 |
| 4,043,539 | 8/1977 | Gilmer et al. | 366/341 |

*Primary Examiner*—Harvey C. Hornsby
*Assistant Examiner*—Christine A. Peterson
*Attorney, Agent, or Firm*—Henry M. Feiereisen

[57] ABSTRACT

A bulk material mixer includes a container accommodating a central tube provided with a plurality of lateral inlet openings at various levels. The inlet openings have a cross section which increases from bottom to top so that the inlet openings at the lowest level have a smallest cross section while the inlet openings at the uppermost level have a greatest cross section.

9 Claims, 3 Drawing Sheets

BULK MATERIAL MIXER

FIELD OF THE INVENTION

The present invention refers to a mixing device in particular for bulk material.

BACKGROUND OF THE INVENTION

Bulk material mixers are known which comprise a container with conical bottom and are suitably equipped to allow withdrawal of substreams of bulk material at various levels with these substreams subsequently combined again.

Such bulk material mixers can be used as gravity mixers or circulation mixers. For example, the German publication DE-AS 17 57 540 discloses a gravity mixer which includes a plurality of vertical pipes provided with a number of lateral openings to allow the withdrawal of substreams of bulk material at different levels. With their lower end, the pipes project through the conical bottom of the container and converge into a common discharge pipe.

The German publication DE-OS 32 08 499 discloses a container which is usable as gravity mixer as well as circulation mixer. The container accommodates a plurality of like funnels which are arranged one above the other with the inlet of each funnel being approximately at the same level as the outlet of the next higher funnel.

The known prior art requires, however, a relatively long mixing time and provides a mixing quality which is not yet satisfactory.

SUMMARY OF THE INVENTION

It is thus an object of the present invention to create an improved bulk material mixer obviating the aforestated drawbacks.

This object and others which will become apparent hereinafter are attained according to the invention by providing the container with a tube which includes at different levels a plurality of inlet openings with a cross section increasing from bottom to top. Preferably, the tube extends at a central location within the container.

Through provision of inlet openings of increasing cross sectional area with ascending level, the mixing time and the mixing quality is considerably improved. The reason for such an improvement resides in the fact that in mixers with a central tube having inlet openings of same cross section, the substreams of bulk material which are withdrawn at different levels and flow through the inlet openings into the central tube vary per time unit upon prevailing free flow conditions within the central tube that is the substreams decrease from bottom to top. On the other hand, the mixing time as well as mixing quality are at an optimum when the substreams of bulk material flowing per time unit from various levels into the central tube are equivalent.

By providing the tube with increasing cross section from bottom to top, equal substreams of bulk material per time unit are obtained when flowing into the tube through the inlet openings thus resulting in optimal mixing time and mixing quality.

Advantageously, the inlet openings are spaced about the circumference of the central tube either uniformly or along a helical line whereby the latter arrangement provides static advantages. It is, however, also within the scope of the present invention to provide the tube with inlet openings of essentially uninterrupted annular or helical columns.

BRIEF DESCRIPTION OF THE DRAWINGS

The above and other objects, features and advantages of the present invention will now be described in more detail with reference to the accompanying drawing in which.

DESCRIPTION OF PREFERRED EMBODIMENTS

Figure 1:
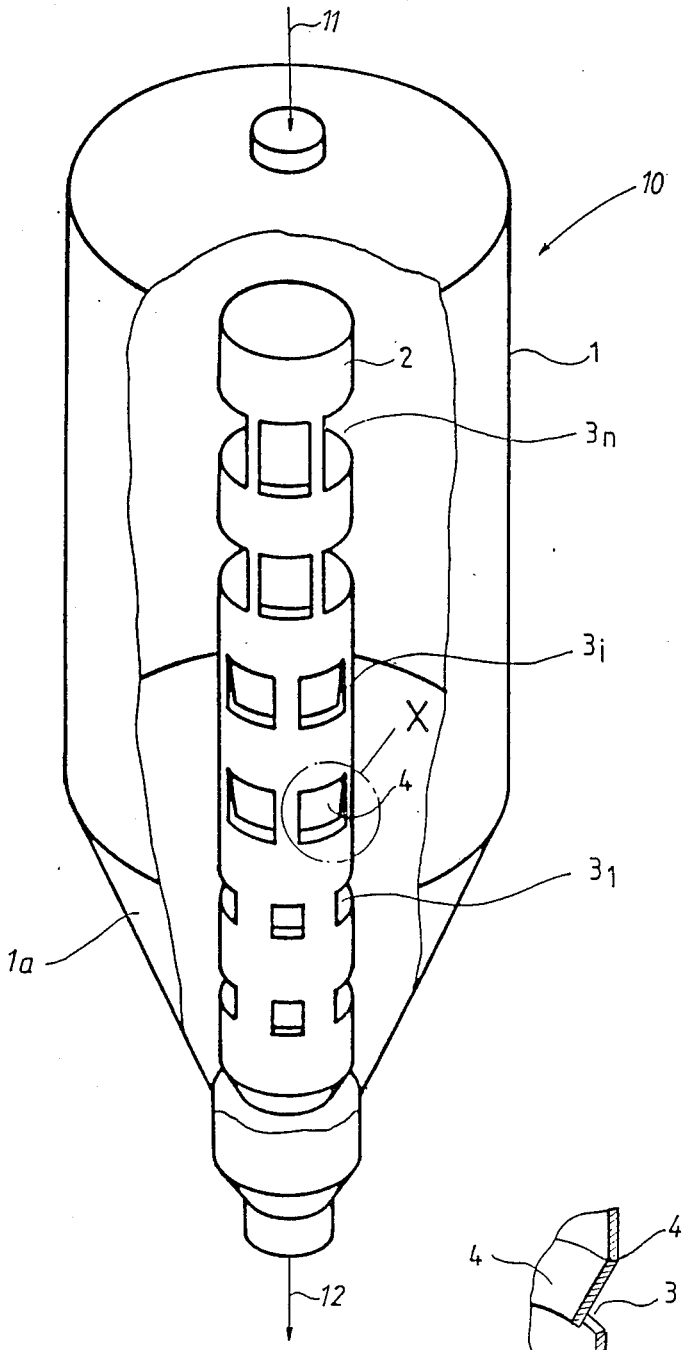
FIG. 1 is a perspective illustration of a first embodiment of a bulk material mixer according to the invention with parts thereof broken away to show its interior.
Figure 2:
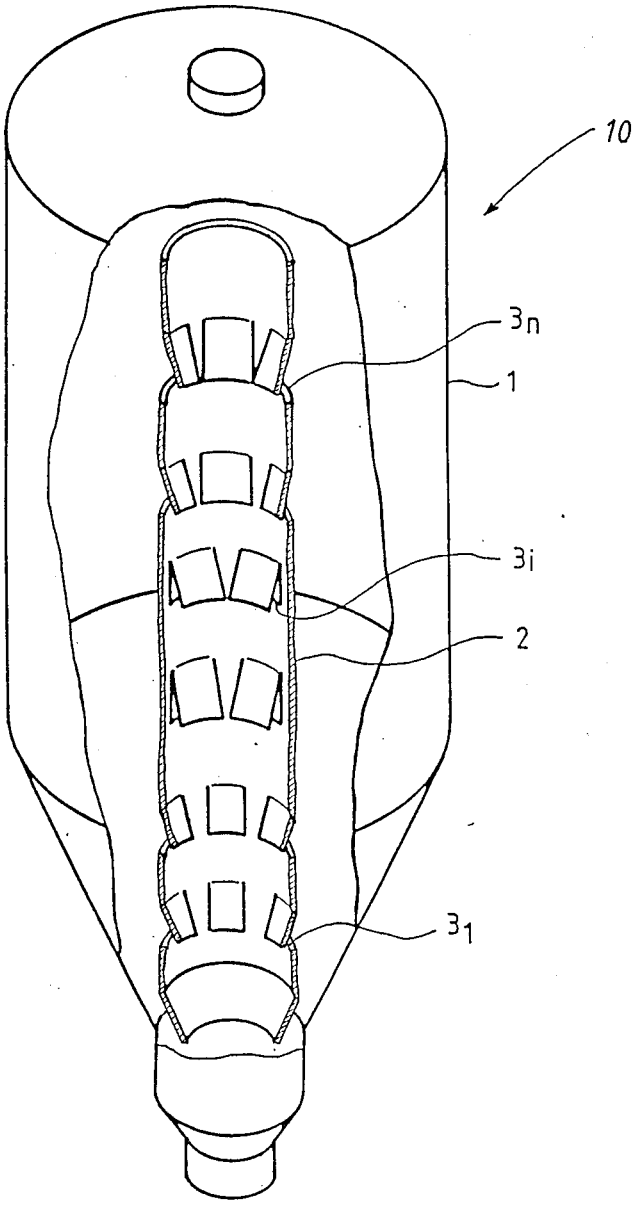
FIG. 2 is a perspective illustration of the bulk material mixer according to FIG. 1 showing the central tube with parts thereof broken away.

Referring firstly to FIGS. 1 and 2, there is shown, in perspective illustration, a first embodiment of a bulk material mixer generally designated by reference numeral 10 and adapted to operate as a gravity mixer. The bulk material mixer 10 includes a cylindrical container 1 whose upper end is e.g. provided with an inlet through which bulk material can be fed, as indicated by arrow 11. At its lower end, the container 1 is connected to a conical or funnel-shaped bottom portion 1*a* which defines an outlet through which the material can be discharged as indicated by arrow 12 and—if necessary—returned to the inlet by suitable means (not shown). Arranged centrally within the container 1 in axial direction thereof is a tube 2 which extends at a vertical distance to the top of the container 1. The central tube 2 projects with its lower end through the bottom 1*b* and communicates with the outlet of the bottom 1*a* to combine respective substreams, as will be described hereinafter.

The central tube 2 is provided with a plurality of lateral inlet openings $3_1$, $3_i$, $3_n$ with the respective index indicating the corresponding level. As is clearly shown in FIG. 1, the cross section of the inlet openings $3_1$, $3_i$, $3_n$ increases with ascending level i.e. the cross section of the inlet openings $3_1$ at the lowermost level is smaller than the cross section of the inlet openings $3_i$ at an intermediate level which in turn have a smaller cross section than the inlet openings $3_n$ at the uppermost level.

Figure 1A:
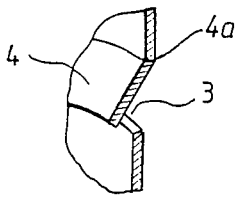
FIG. 1*a* is a fragmentary perspective illustration, on a somewhat larger scale, showing an inlet opening of the bulk material mixer according to section X in FIG. 1.

Turning now to FIG. 2, it may be seen that each inlet opening $3_1$, $3_i$, $3_n$ cooperates with a respective screening element 4. As is especially illustrated in FIG. 1*a* which shows the area of one exemplified inlet opening 3 on an enlarged scale in accordance with section X in FIG. 1, the screening element 4 covers nearly the entire cross section of the inlet opening 3 and extends slantingly inwardly and downwardly toward the interior of the central tube 2 from a top edge 4*a* defining the inlet opening 3. Through provision of such screening elements 4, the bulk material descending toward the bottom portion 1*a* by way of gravity and entering through the various inlet openings $3_1$, $3_i$, $3_n$ into the central tube 2 is protected against the bulk material flowing within the central tube 2, and thus the supply of material through the inlet openings $3_1$, $3_i$, $3_n$ is unimpeded.

The inlet openings $3_1$, $3_i$, $3_n$ may be uniformly spaced about the circumference of the central tube 2 as shown in FIG. 1; however, any other suitable arrangement of these inlet openings is possible as long as the cross section of the inlet openings increases with ascending level. For example, the inlet openings may be spaced about the circumference of the central tube 2 along a helical line. It should also be noted that the number of inlet openings of the central tube may differ from the nonlimiting example as illustrated in the drawing.

Figure 3:
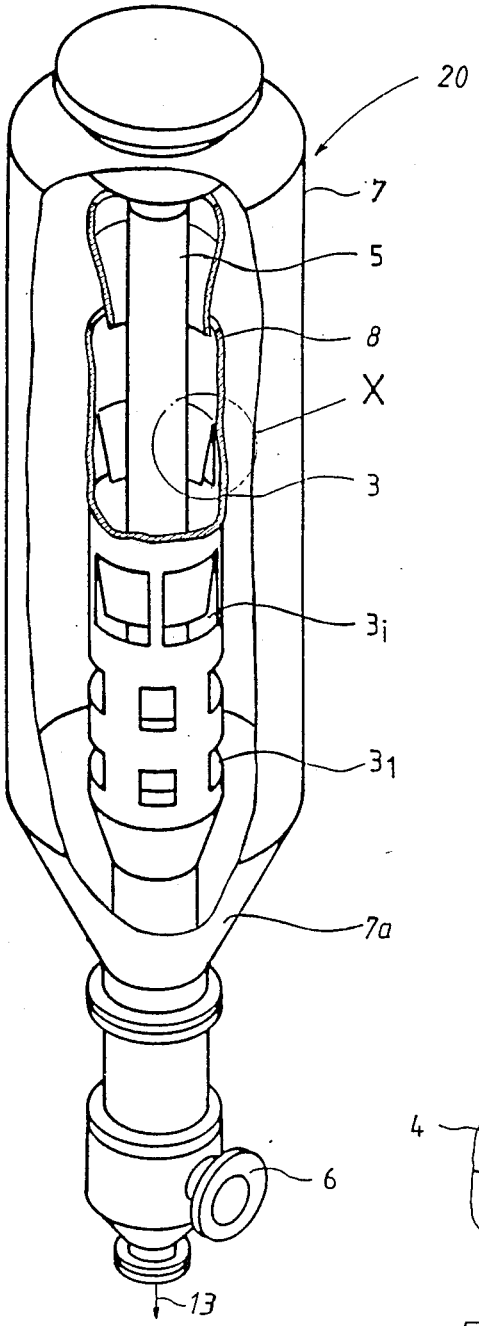
FIG. 3 is a perspective illustration of a second embodiment of a bulk material mixer according to the invention with parts thereof broken away to show its interior.
Figure 3A:
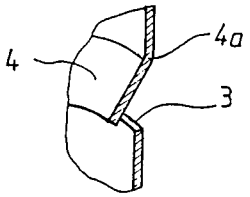
FIG. 3*a* is a fragmentary perspective illustration, on a somewhat larger scale, showing an inlet opening of the bulk material mixer according to section X in FIG. 3.

Turning now to FIG. 3 which shows in perspective illustration a second embodiment of a bulk material mixer generally designated by reference numeral 20 and adapted to operate as a circulation mixer. The bulk material mixer 20 includes a cylinder container 7 with conical bottom portion 7*a*. Extending within the container 7 is a central tube 8 which essentially corresponds to the central tube 2 as illustrated in FIG. 1 and includes a plurality of inlet openings $3_1$, $3_i$ which have a cross section increasing with ascending level.

Arranged concentrically within the central tube 8 is a riser pipe 5. The discharge of the container 7 is designed in known manner so as to provide a suitably long packing path and to allow the flow of bulk material exiting the central tube 8 to be supplied to the riser pipe 5 by means of e.g. a blower (not shown) which is linked to a connecting piece 6. The blower supplies a suitable air flow to return the bulk material back toward the upper part of the container 7 and thus allows the bulk material to be pneumatically circulated. When desired, the mixed material can be withdrawn from the container through an appropriate outlet as e.g. indicated by arrow 13, with the blower 20 turned off beforehand.

In the embodiment of the bulk material mixer 10 according to FIG. 1 or in the embodiment of the bulk material mixer 20 according to FIG. 3, the free cross section area of the lateral inlet openings $3_1$, $3_i$, $3_n$ at the corresponding level is governed by the following relationship:

$$A_i = \frac{\dot{M}_{ges}}{[(n+1)-i] \cdot v_{ges} \cdot \rho}$$

wherein $A_i$ represents the free total cross section area of all inlet openings at a respective level i with i representing the index for the respective level $\dot{M}_{ges}$ represents the total mass flow discharged from the central tube n represents the number of levels $v_{ges}$ represents the velocity of the flow of bulk material upon discharge from the lower end of the central tube $\rho$ represents the bulk density (apparent density) of the bulk material.

When considering the relationship $$\dot{M}_{ges} = A.v_{ges}.\rho$$

wherein

A represents the free cross section area of the central tube;

the free cross section area of the inlet openings in dependence of the index of the level is governed by the following simplified relationship:

$$A_i = \frac{A}{n+1-i}$$

wherein

A represents the free cross section area of the central tube.

While the invention has been illustrated and described as embodied in a Bulk Material Mixer, it is not intended to be limited to the details shown since various modifications and structural changes may be made without departing in any way from the spirit of my present invention.

What is claimed as new and desired to be protected by Letters Patent is set forth in the appended claims:

We claim:

1. A mixing device in particular for bulk material, comprising:

a container defining an axis; and means for withdrawing substreams of material at various levels during the flow of the bulk material and including a tube defining an interior space and extending in direction of said axis within said container, said tube including a plurality of inlet openings at various levels thereof for allowing substreams of material to enter said tube, said inlet openings having a cross section from inlet opening to inlet opening increasing with ascending level from bottom to top in such a manner that substreams withdrawn from various levels are at least approximately the same per unit of time.

2. A device as defined in claim 1 wherein each inlet opening is confined by a top edge of said tube, and further comprising a screening element associated to each inlet opening and extending inwardly from said top edge toward the interior of said tube.

3. A device as defined in claim 2 wherein each screening element extends slantingly inwardly and downwardly and covers essentially the entire cross section of the pertaining one of said inlet openings.

4. A device as defined in claim 1 wherein said inlet openings are uniformly spaced about the circumference of said tube.

5. A device as defined in claim 1 wherein said inlet openings are spaced along a helical line about the circumference of said tube.

6. A device as defined in claim 1, and further comprising circulating means for returning the material upwardly and including a riser pipe arranged concentrically within said tube.

7. A device as defined in claim 1 wherein said tube extends at a central location within said container.

8. A device as defined in claim 1 wherein said cross section of said inlet openings at each level is governed by the following relationship:

$$A_i = \frac{\dot{M}_{ges}}{[(n+1)-i] \cdot v_{ges} \cdot \rho}$$

wherein $A_i$ represents the free total cross section of all inlet openings at a respective level i with i representing the index for the respective level $\dot{M}_{ges}$ represents the total mass flow discharged from the central tube n represents the number of levels $v_{ges}$ represents the velocity of the flow of bulk material at discharge from the lower end of the central tube $\rho$ represents the bulk density (apparent density) of the bulk material.

9. A mixing device as defined in claim 1 wherein said tube is of cylindrical shape.

* * * * *